US005761838A

United States Patent [19]

Chisholm et al.

[11] Patent Number: 5,761,838

[45] Date of Patent: Jun. 9, 1998

[54] ILLUMINATED ORNAMENT

[75] Inventors: Brian J. Chisholm, Glenshaw; Lori Ann Melchiorre; Kathleen Kendra, both of Penn Hills, all of Pa.

[73] Assignee: CubeWorks, Incorporated, Pittsburgh, Pa.

[21] Appl. No.: 717,514

[22] Filed: Sep. 20, 1996

[51] Int. Cl.[6] ..... A47G 1/06

[52] U.S. Cl. ..... 40/716; 428/7; 40/781

[58] Field of Search ..... 40/714, 713, 716, 40/367, 564, 576, 781; 428/7

[56] References Cited

U.S. PATENT DOCUMENTS

| | | | |
|---|---|---|---|
| 1,988,765 | 1/1935 | Wolf . | |
| 2,118,900 | 2/1938 | Schade . | |
| 2,623,314 | 12/1952 | Lombard | 40/367 |
| 2,902,787 | 9/1959 | Cook | 40/716 |
| 3,694,648 | 9/1972 | Yates . | |
| 4,452,836 | 6/1984 | Daniel, Jr. . | |
| 5,018,291 | 5/1991 | Pasquale et al. | 40/781 |
| 5,116,648 | 5/1992 | Martin et al. . | |
| 5,175,029 | 12/1992 | Peterson . | |

OTHER PUBLICATIONS

Savage Pre–Vu Mount Transparency Presentation Viewing System by Savage Universal Corp., Tempe, AZ Exact date unknown.

*Primary Examiner*—Cassandra H. Davis
*Attorney, Agent, or Firm*—Paul A. Beck & Associates

[57] ABSTRACT

An ornament for displaying a standard 35 mm slide mount including removable planar frame member to hold the transparency, a body member with integral device for attaching the ornament to a decorative string of lights, a reflector within the body member for reflecting light toward the 35 mm slide to be viewed, and a diffuser within the body member to diffuse the light directed toward the 35 mm slide to be viewed. The removable planar frame may be rectangular in shape to simulate a picture frame.

4 Claims, 7 Drawing Sheets

ILLUMINATED ORNAMENT

BACKGROUND OF THE INVENTION

1. Field of the Invention

This invention relates to ornamental devices and in particular to an illuminated ornamental device which displays a 35 mm slide in a standard 35 mm slide mount.

2. Description of the Prior Art

U.S. Pat. No. 3,694,648 issued Sep. 26, 1972 to Yates, discloses a Christmas tree ornament having a lens and a light built into the ornament, together with an externally accessible slot for receiving a transparency which then may be viewed through the lens. There is no disclosure by Yates of: (i) a removable planar frame member; and (ii) a means for placing the transparency against the removable planar frame member.

U. S. Pat. No. 5,116,648 issued May 26, 1992 to Martin et al., discloses a Christmas tree ornament in the form of folded heavy cardboard for receiving a photograph. There is no disclosure by Martin et al., of (i) a removable planar frame member; (ii) means for providing illumination; (iii) a means for providing a reflector; and (iv) a means for providing a diffusing element.

U.S. Pat. No. 5,175,029 issued Dec. 29, 1992 to Peterson, discloses a Christmas tree ornament for displaying three images or messages on an internal mounting frame attached to a bottom piece which is attached to a top piece. There is no disclosure by Peterson of: (i) a removable planar frame member; (ii) a means for providing illumination; (iii) a means for providing a reflector; and (iv) a means for providing a diffusing element.

U.S. Pat. No. 4,452,836 issued Jun. 5, 1984 to Daniel Jr., discloses an assembly for attachment of light bulbs to a hollow ornament, such as a Christmas tree ornament, for illumination of the ornament. There is no disclosure by Daniel Jr., of (i) a removable planar frame member; (ii) a means for providing a reflector; and (iii) a means for providing a diffusing element.

SUMMARY OF THE INVENTION

The present invention provides an improved ornamental device permitting an illuminated viewing of a 35 mm slide in a standard 35 mm slide mount horizontally or vertically, while providing a pleasing aesthetic appearance. More specifically, the invention comprehends providing an ornament including a body member, and a device on the body member for attachment to any ordinary decorative string of lights, such as Christmas tree lights, to provide illumination. A removable planar frame member within the body member holds a 35 mm slide in a standard 35 mm slide mount to be viewed. A reflector within the body member reflects light toward the 35 mm slide. A diffuser within the body member diffuses the light directed toward the 35 mm slide. The removable planar frame member that holds the 35 mm slide in a standard 35 mm slide mount is removable to facilitate insertion of any 35 mm slide in a standard 35 mm and can be oriented in either a vertical or horizontal format. The illuminated slide can be viewed against an opening in the removable planar frame member. Where the 35 mm slide is to be viewed, the illuminating components are arranged to provide substantially diffused, even light for improved aesthetic viewing.

The ornament may generally simulate a decorative picture frame. The body member may be textured and colored to provide a highly aesthetic ornament.

The ornament may be arranged in a series of ornaments to carry a plurality of 35 mm slides to be viewed and the illumination means may be arranged to provide illumination for each of the images.

The ornament may be arranged to permit the removal and insertion of 35 mm slides in a standard 35 mm slide mounts to be viewed whereby the slides in a standard 35 mm slide mounts may be installed and removed by the user as desired. The ornament is relatively light in weight, permitting it to be attached to an ordinary decorative string of lights.

BRIEF DESCRIPTION OF THE DRAWINGS

Other features and advantages of the invention will be apparent from the following description taken in connection with the accompanying drawings wherein.

DESCRIPTION OF THE PREFERRED EMBODIMENTS

Reference will now be made in detail to the present preferred embodiment of the invention as illustrated in the accompanying drawings.

Figure 1:
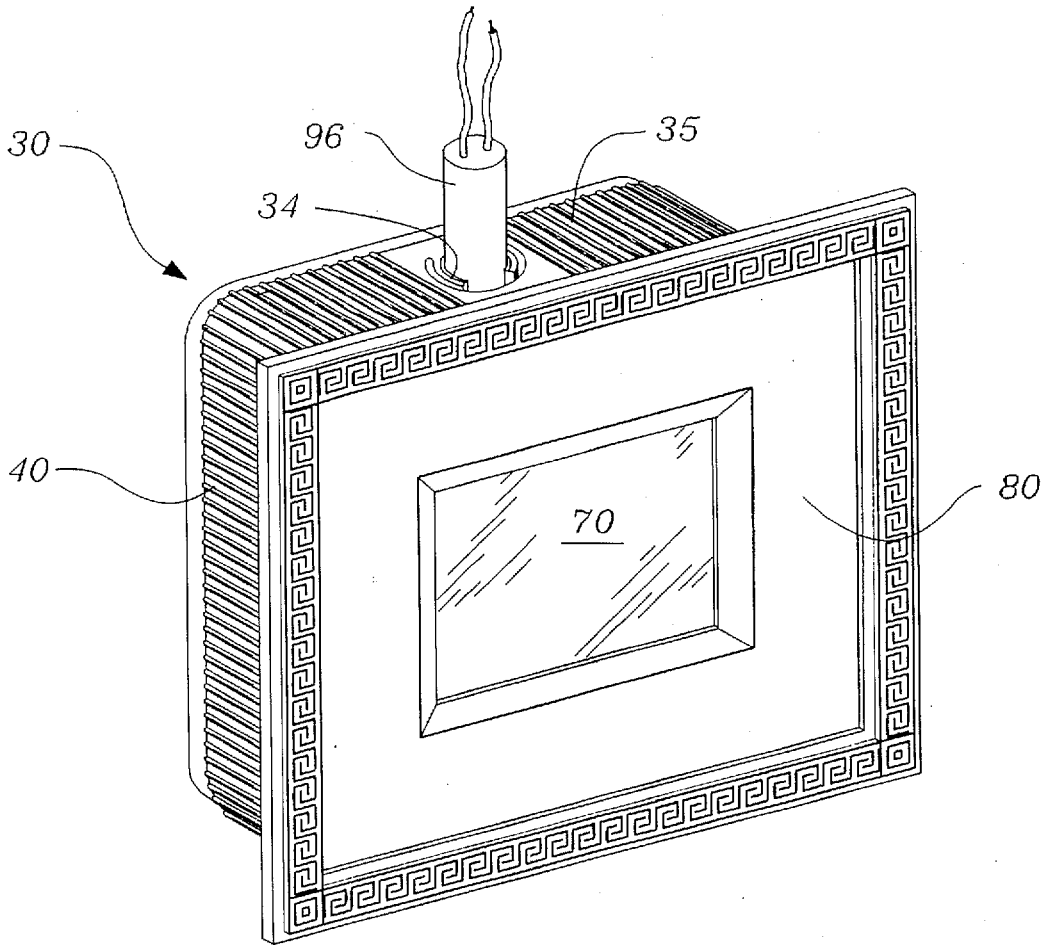
FIG. 1 is a front perspective view of the ornament attached to a light fixture from a decorative string of lights.

In FIG. 1 there is illustrated an ornament 30 hanging from a decorative light fixture 96. The ornament 30 defines a body member 40 and a removable planar frame member 80. In accordance with the invention, body member 40 has incorporated into its side member 44 an integral attachment device 34 for attachment to light fixture 96. This will be illustrated more clearly in following drawings. Ornamental device 30 is adapted for personalization by the user through utilization of a slide in a standard 35 mm slide mount 70. Such ornaments may be used in series with a plurality of ornaments hung on a Christmas tree, or set on a mantle.

Figure 2:
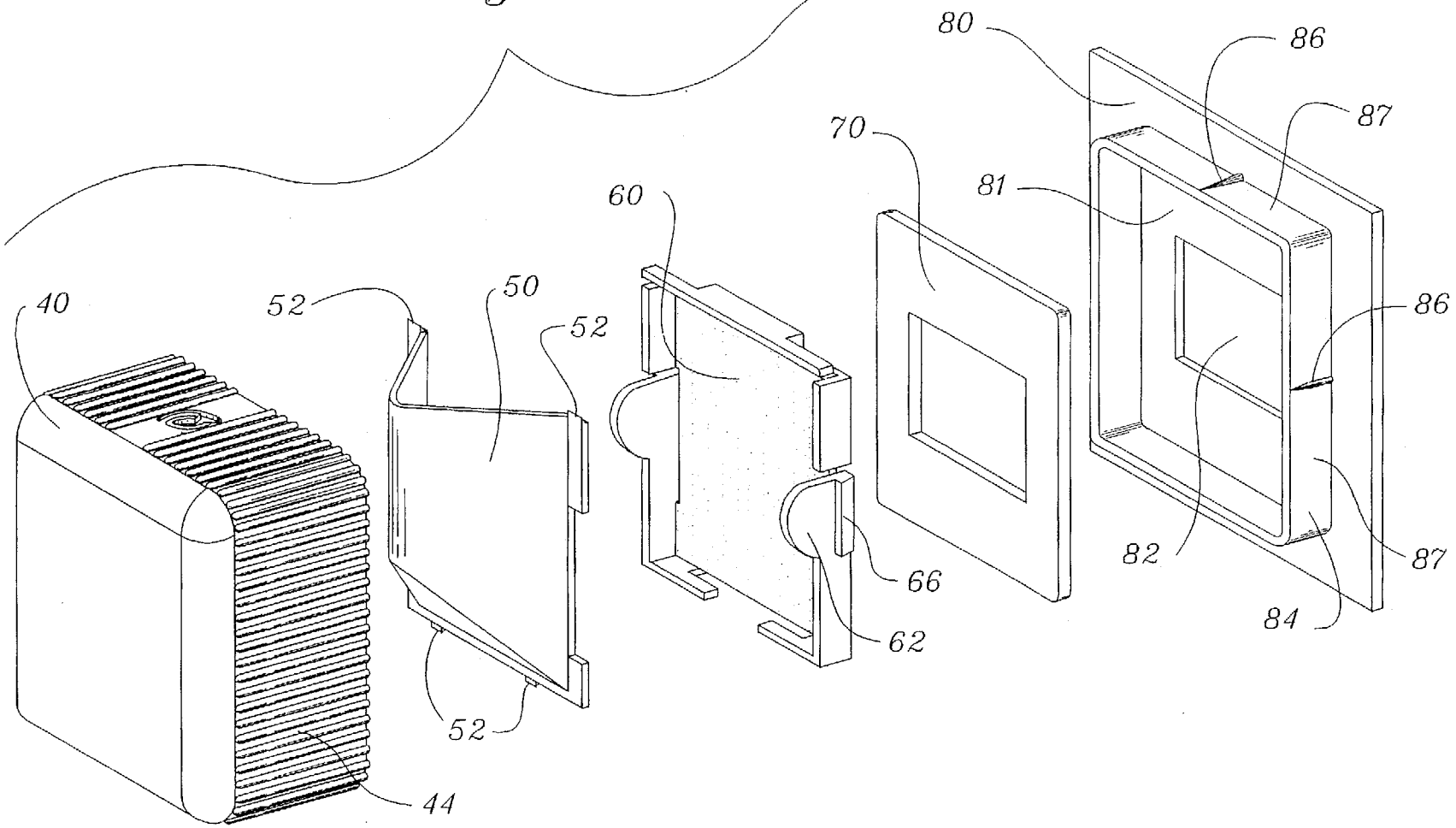
FIG. 2 is an exploded view of all components of the ornament.

FIG. 2 is an exploded view of the ornament 30 illustrating body member 40, reflector 50, diffuser 60, 35 mm slide in a standard 35 mm slide mount 70, and removable planar frame member 80.

Figure 3:
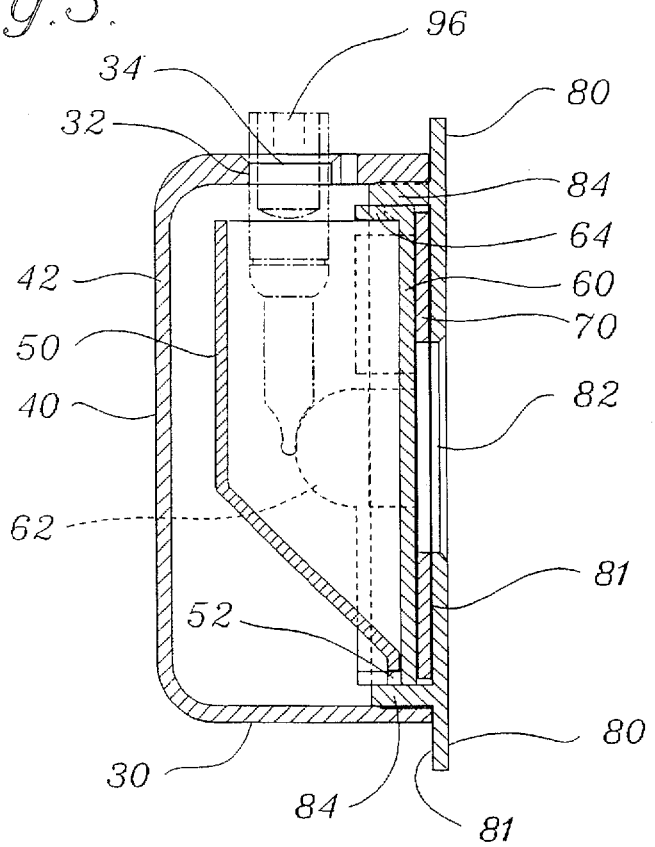
FIG. 3 is in elevational sectional view of all components assembled.
Figure 4:
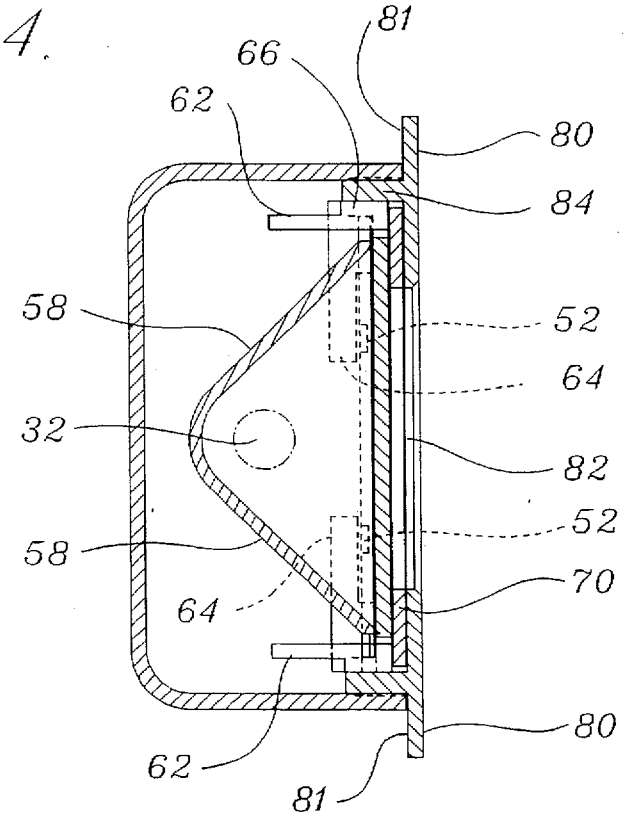
FIG. 4 is a top transverse sectional view of all components.

FIGS. 3 and 4 Illustrate the assembled components in their proper order. Ornamental device 30 has a body member 40 held in concert with removable planar frame member 80 through a friction fit. A 35 mm slide in a standard 35 mm slide mount 70 is held between the inner side 81 of removable planar frame member 80 and diffuser 60. Diffuser 60 is held in place adjacent to 35 mm slide in a standard 35 mm slide mount 70 through a friction fit with integral flange member 84. Diffuser protrusion tabs 62 provide a friction fit for diffuser 60 through surface connection of friction pads 66 with integral flange member 84. Reflector 50 is held rearwardly of 35 mm slide in a standard 35 mm slide mount 70 by diffuser 60 through snap connections 64 and connection wedges 52.

Illumination for the 35 mm slide 70 is provided by light fixture 96 inserted through hole 32 and held forward of reflector 50 and rearward of diffuser 60 with integral attachment device 34. 35 mm slide 70 is viewed through rectangular opening 82 in removable planar frame member 80. Rectangular opening 82 is not to be substantially greater than 33 mm×22 mm.

FIGS. 5 through 8 illustrate in greater detail the body member 40 and the integral attachment device 34. Body member 40 comprises a back 42 and side member 44 creating an open container for the remaining components. Integral attachment is so positioned within the top portion 35 of the side member 44 to provide a mechanical connection for a centered and accurately positioned light fixture 96.

Figure 6:
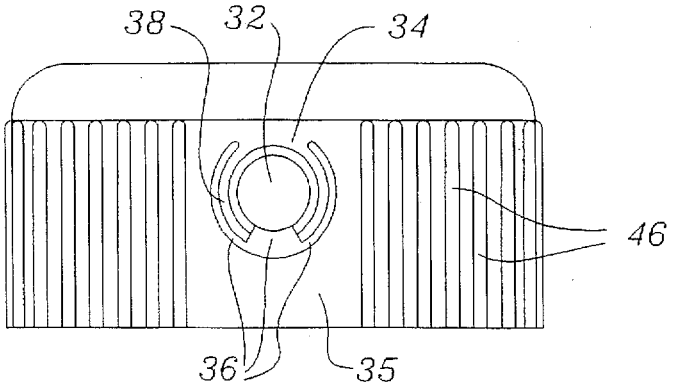
FIG. 6 is a top elevational view of FIG. 5.
Figure 5:
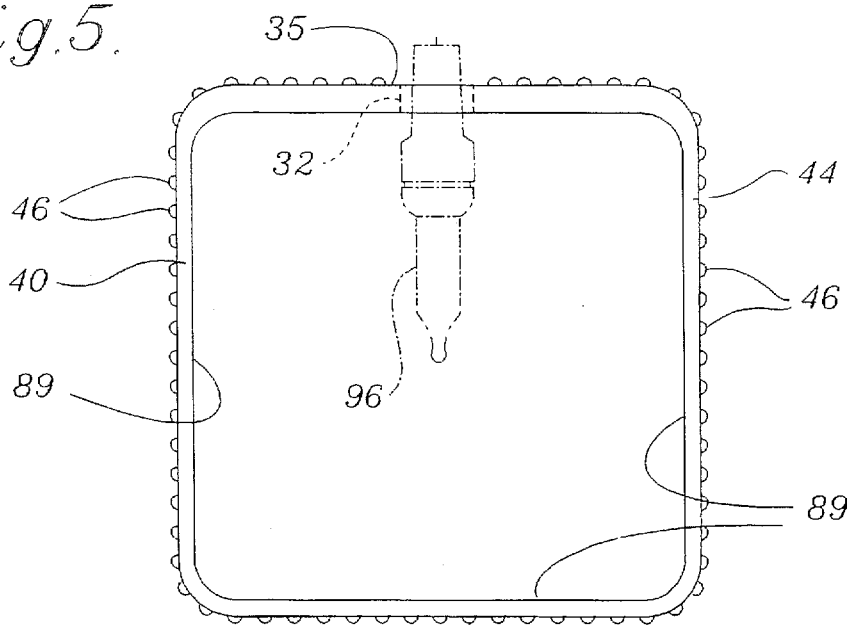
FIG. 5 is a front elevation of the body member with a light fixture.
Figure 8:
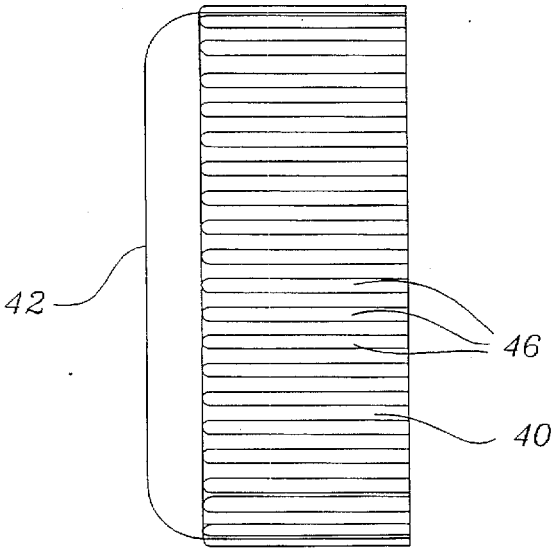
FIG. 8 is a side elevational view of FIG. 5 as viewed from the left.
Figure 7:
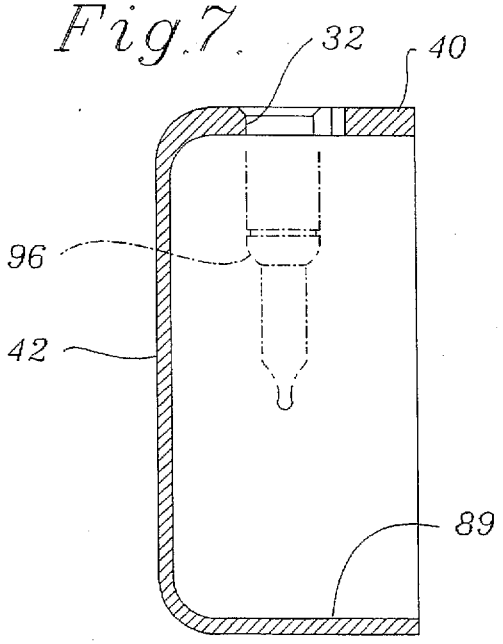
FIG. 7 is a side sectional view of FIG. 5.
Figure 9:
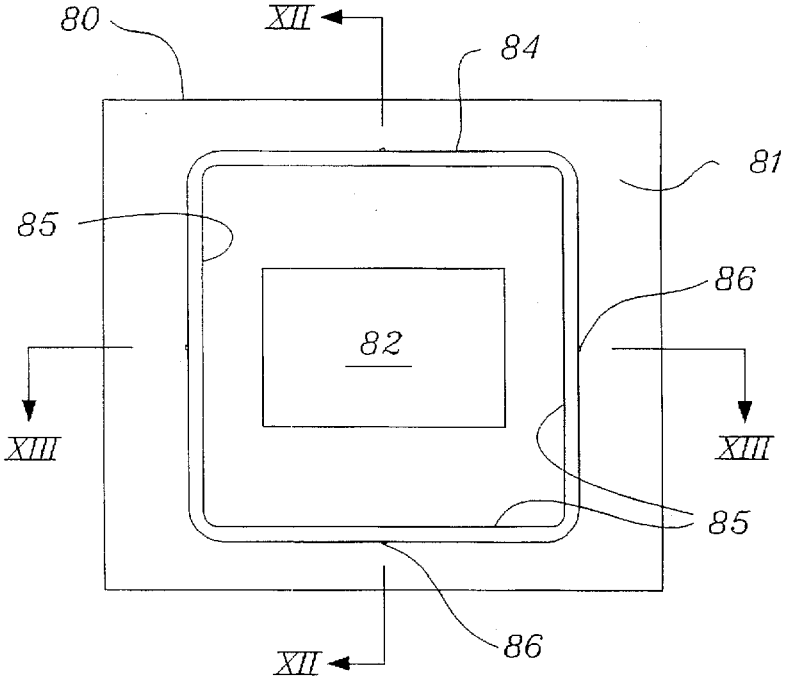
FIG. 9 is a rear elevational view of the removable planar frame member.
Figure 10:
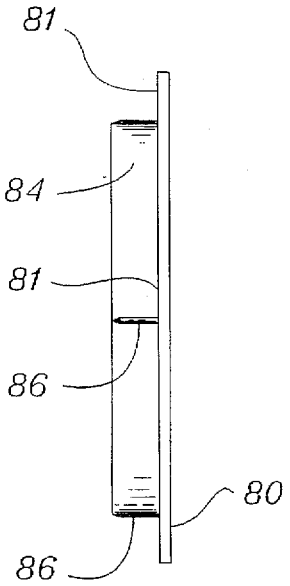
FIG. 10 is a side elevational view of FIG. 9.
Figure 11:
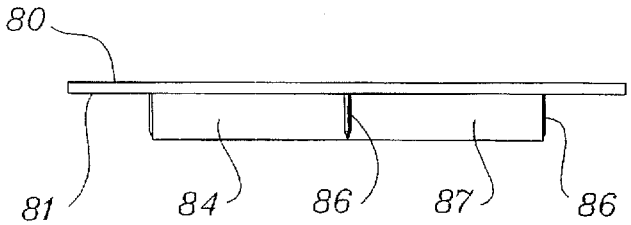
FIG. 11 is a top elevational view of FIG. 9.
Figure 12:
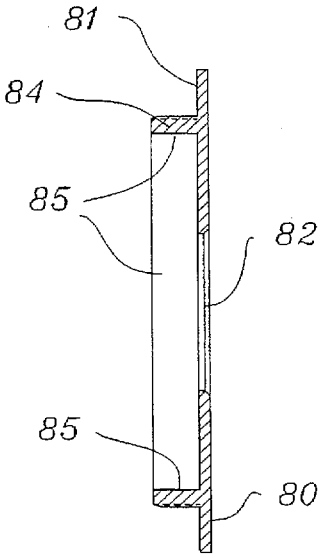
FIG. 12 is a vertical sectional view of FIG. 9 taken along Line XII—XII.
Figure 13:
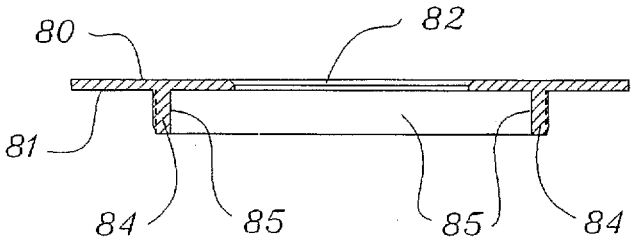
FIG. 13 is a transverse sectional view of FIG. 9 along Line XIII—XIII.
Figure 15:
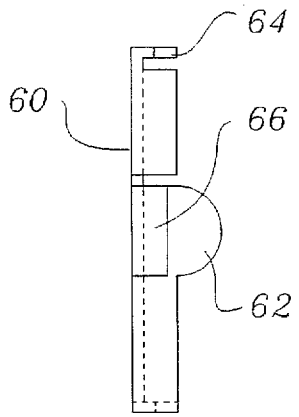
FIG 15 is a side elevational view of FIG. 14.
Figure 14:
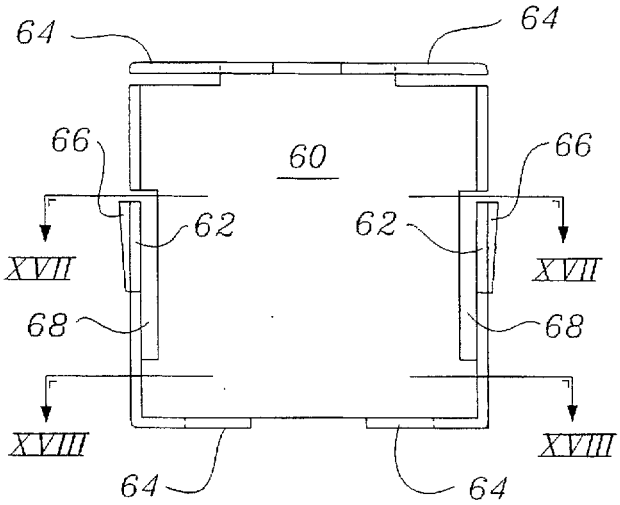
FIG. 14 is a front elevational view of the diffuser.
Figure 16:
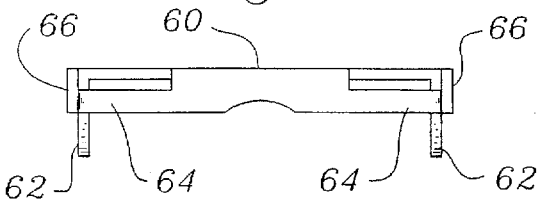
FIG. 16 is a top plan view of FIG. 14.
Figure 17:
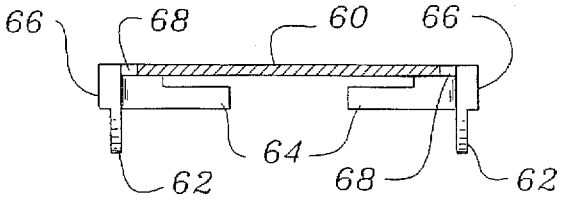
FIG. 17 is a transverse sectional view taken on line XVII—XVII of FIG. 14.
Figure 18:
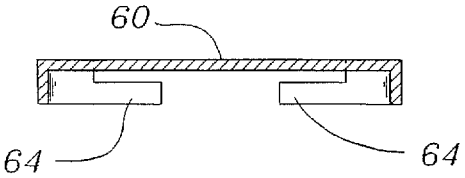
FIG. 18 is a transverse sectional view taken along line XVIII—XVIII of FIG. 14.

FIGS. 5 and 6 show light fixture 96 centered and positioned properly within body member 40. FIGS. 5, 6 and 8 illustrate decorative ribs 46 which may be added to body member 40 to give the effect of a ribbon texture. Integral attachment device 34 is constructed to provide curved element 38 which when slid around light fixture 96 provides sufficient grip to hold ornament 30 in place. Curved element 38 is so constructed to have a diameter not substantially larger than 7 mm.

Opening 36 provides ventilation for heat generated by light fixture 96. The complete ornament 30, with integral attachment device 34, is constructed of a plastic material such as high impact polystyrene which does not conduct electricity. This is an important safety feature in as much as the device is used in conjunction with electric lights. The plastic material is capable of withstanding the heat generated from the lights which may be utilized in conjunction with the invention. The characteristics of the high impact polystyrene plastic make the device, safe, sturdy, lightweight, and inexpensive to manufacture.

FIGS. 9 through 13 illustrate in greater detail the removable planar frame member 80, rectangular opening 82, integral flange member 84, and friction wedges 86. Removable planar frame member 80 is constructed with integral flange member 84 perpendicular and adjacent to inner side 81 and centered around opening 82. Integral flange member 84 receives within its inner walls 85 transparency 70 and holds 35 mm slide in a standard 35 mm slide mount 70 centered over opening 82. Integral flange member 84 also receives diffuser 60 which holds 35 mm slide in a standard 35 mm slide mount 70 snugly adjacent to inner side 81. The diffuser 60 with the reflector 50, are held within integral flange member 84 by friction fit provided by friction pads 66. Pressure for the friction fit to friction pads 66 is provided by protrusion tabs 62. The 35 mm slide in a standard 35 mm slide mount 70 can be either horizontal or vertical in format. Body member 40 and integral flange member 84 are square in shape so that removable planar frame member 80, along with 35 mm slide in a standard 35 mm slide mount 70, may be oriented either horizontally or vertically within body member 40 maintaining integral attachment device 34 always at the top. This ensures that the ornament 30 will always be oriented properly with regard to the light fixture 96 regardless of the orientation of 35 mm slide in a standard 35 mm slide mount 70. Friction wedges 86 are spaced in the center of each side of an outside surface 87 of the integral flange member 84 to slightly displace inside surface 89 of body member 40 when integral flange member 84 is inserted into body member 40. The friction fit provided by friction wedges 86 holds the removable planar frame member 80 snugly to the body member 40.

Figure 19:
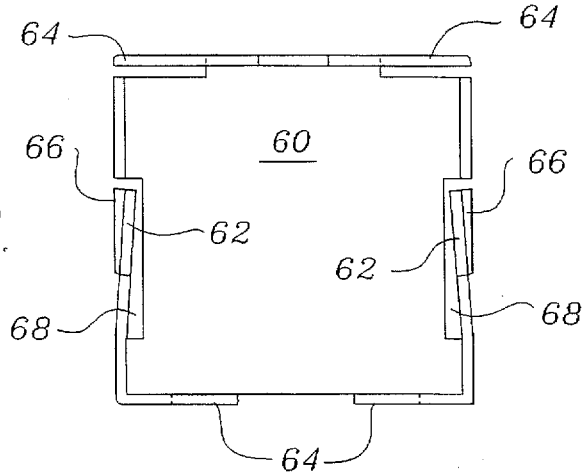
FIG. 19 is a view similar to FIG. 14 with the side protrusion tabs compressed.

FIGS. 14 through 19 illustrate in greater detail diffuser 60, protrusion tabs 62, snap components 64, and friction pads 66. Diffuser 60 is constructed of a translucent plastic material sufficient to diffuse the light from the light fixture 96 to create an even and pleasing light source. Protrusion tabs 62 use the inherent flexibility of the plastic material to exert pressure with friction pads 66 against inner walls 85 of integral flange member 84. Tab spaces 68 provide space for the tabs to move into when compressed. FIG. 19 illustrates protrusion tabs 62 and friction pads 66 in compressed position. Snap components 64 at the top and bottom of diffuser 60 permit the mechanical connection of the diffuser 60 with the reflector 50. When the reflector 50 is inserted into diffuser 60, connection wedges 52 engage under snap components 64 to provide solid connection.

Figure 20:
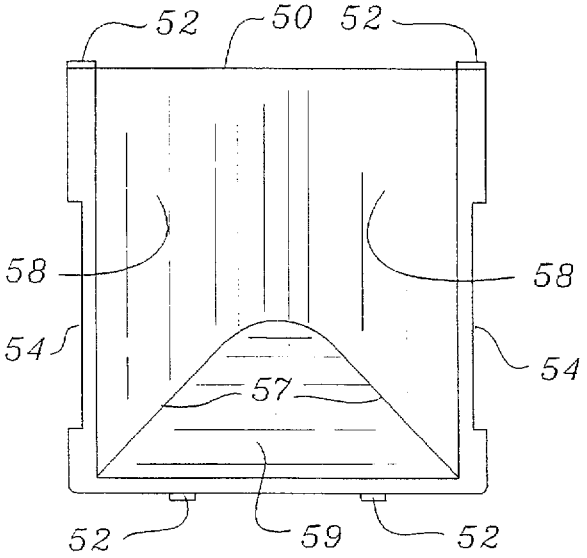
FIG. 20 is a front elevational view of the reflector.
Figure 22:
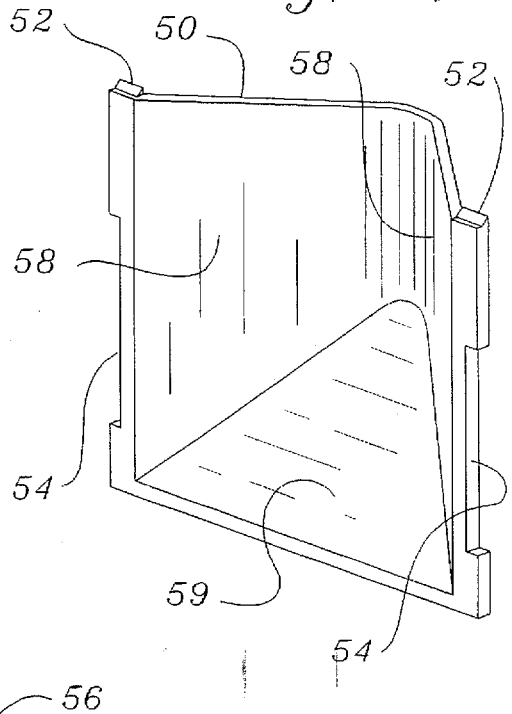
FIG. 22 is a front perspective view of FIG. 20.
Figure 23:
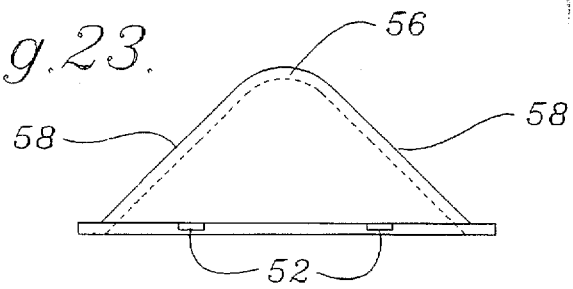
FIG. 23 is a top elevational view of FIG. 20.
Figure 24:
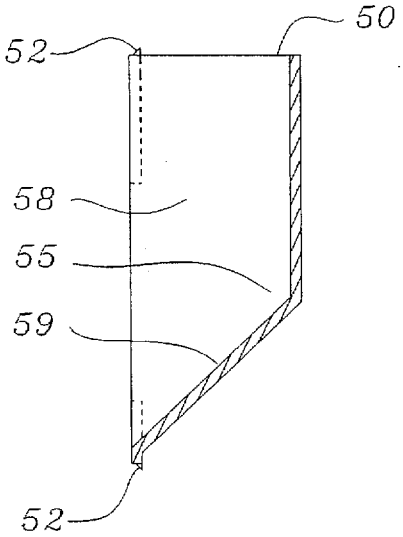
FIG. 24 is a vertical sectional view of FIG. 21 taken along line XXIV—XXIV.
Figure 21:
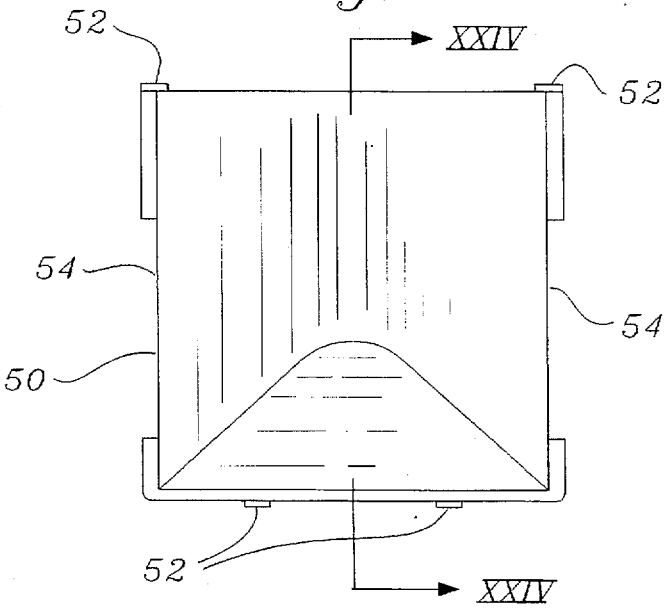
FIG. 21 is a rear elevational view of FIG. 20.

FIGS. 20 through 24 illustrate in greater detail reflector 50. FIG. 20 shows the front view of reflector 50 illustrating the connection wedges 52, and protrusion tab cutouts 54. Connection wedges 52 are so constructed to push snap components 64 away from reflector 50 until reflector 50 is fully adjacent the diffuser 60 at which time snap connectors 64 return to their original position above connection wedges 52, locking reflector 50 in place. Cut outs 54 allow for full movement of diff-user protrusion tabs 62 when reflector 50 is engaged with diffuser 60. The reflector 50 and the diffuser 60 are made of different materials to provide specific performance. The reflector 50 is constructed of a bright white hi-impact polystyrene plastic. The diffuser 60 is constructed of a translucent material to allow light to pass through and become diffused. It is best if these two separate parts, constructed of two different materials, are joined together as a single unit. The mechanical connection provided by the snap components 64 and connection wedges 52 allow for a solid and economical connection during manufacturing. The unique shape of the reflector 50 is comprised of panels 58 extending from a common vertex 56 and diverging from common vertex 56. A third panel 59 triangularly shaped with a vertex point abutting the common vertex and having opposite edges 57 which abut the panels 58, the third panel forming an obtuse angle 55 with the common vertex. This unique construction provides maximum reflectance for light fixture 96 within body member 40. This effective reflector combined with the diffuser element provide a bright, even light source to view the 35 mm slide.

While we have described presently preferred embodiments of the invention it is to be distinctly understood that the invention is not limited, but may be otherwise embodied and practiced within the scope of the following claims.

We claim:

1. An ornament for displaying a 35 mm slide supported by a standard 35 mm slide mount comprising:

(a.) a removable planar frame member having: an inner side with a rectangular shaped opening not larger than substantially 33 mm×22 mm; and an integral flange member having inner sides and outer sides extending perpendicularly from the inner side of the planar frame member and formed in a closed rectangle and precisely sized to receive the standard 35 mm slide mount within the inner sides of the flange member;

(b.) a body member having a back and side member which extends from the back and forms an open container, the inner side of the planar frame member abutting the side member and spaced oppositely from the back, the flange member outer sides frictionally engaging the side member, the standard 35 mm slide mount can be placed against the inner side of the planar frame member within the flange member precisely covering the opening with with the 35 mm slide;

(c.) a reflector means within the body member and reflecting light in in a direction from the back of the body member toward the rectangular shaped opening in the planar member and having first and second panels extending from a common vertex and diverging from the common vertex, a third panel triangularly shaped with a vertex point abutting the common vertex and having opposite edges which abut the first and second panels, the third panel forming an obtuse angle with the common vertex; and (d.) a diffuser means joined with the reflector means and adjacent the planar frame member and covering the rectangular shaped opening and within the body member and diffusing light within the body member directed toward the opening in the planar frame member.

2. An ornament for displaying a 35 mm slide supported by a standard 35 mm slide mount comprising:

(a.) a removable planar frame member having: an inner side with a rectangular shaped opening not larger than substantially 33 mm×22 mm; and an integral flange member having inner sides and outer sides extending perpendicularly from the inner side of the planar frame member and formed in a closed rectangle and precisely sized to receive the standard 35 mm slide mount within the inner sides of the flange member;

(b.) a body member having a back and a side member which extends from the back and forms an open container, the inner side of the planar frame member abutting the side member and spaced oppositely from the back, the flange member outer sides frictionally engaging the side member, the standard 35 mm slide mount can be placed against the inner side of the planar frame member within the flange member precisely covering the opening with the 35 mm slide;

(c.) a reflector means within the body member and reflecting light in a direction from the back of the body member toward the rectangular shaped opening in the planar member; and (d.) a diffuser means joined with the reflector means and adjacent the planar frame member and covering the rectangular shaped opening and within the body member and diffusing light within the body member directed toward the opening in the planar frame member, the diffuser means has a pair of parallel oppositely positioned protrusions extending from the diffuser means toward the back of the body member.

3. An ornament displaying a 35 mm slide supported by a standard 35 mm slide mount comprising:

(a.) a removable planar frame member having: an inner side with a rectangular shaped opening not larger than substantially 33 mm×22 mm; and an integral flange member having inner sides and outer sides extending perpendicularly from the inner side of the planar frame member and formed in a closed rectangle and precisely sized to receive the standard 35 mm slide mount within the inner sides of the flange member;

(b.) a body member having a back and a side member which extends from the back and forms an open container, the inner side of the planar frame member abutting the side member and spaced oppositely from the back;

(c.) a reflector means within the body member and reflecting light in a direction from the back of the body member toward the rectangular shaped opening in the planar member, and having first and second panels extending from a common vertex and diverging from the common vertex, a third panel triangularly shaped with a vertex point abutting the common vertex and having opposite edges which abut the first and second panels, the third panel forming an obtuse angle with the common vertex;

(d.) a diffuser means joined with the reflector means and adjacent the planar frame member and covering the rectangular shaped opening and within the body member and diffusing light within the body member directed toward the opening in the planar frame member; and (e.) the 35 mm slide in the standard 35 mm slide mount placed adjacent the inner side of the removable planar frame member and covering the opening.

4. An ornament displaying a 35 mm slide supported by a standard 35 mm slide mount comprising:

(a.) a removable planar frame member having: an inner side with a rectangular shaped opening not larger than substantially 33 mm×22 mm; and an integral flange member having inner sides and outer sides extending perpendicularly from the inner side of the planar frame member and formed in a closed rectangle and precisely sized to receive the standard 35 mm slide mount within the inner sides of the flange member;

(b.) a body member having a back and a side member which extends from the back and forms an open container, the inner side of the planar frame member abutting the side member and spaced oppositely from the back;

(c.) a reflector means within the body member and reflecting light in a direction from the back of the body member toward the rectangular shaped opening in the planar member;

(d.) a diffuser means joined with the reflector means and adjacent the planar frame member and covering the rectangular shaped opening and within the body member and diffusing light within the body member directed toward the opening in the planar frame member, the diffuser has a pair of parallel oppositely positioned protrusions extending from the diffuser means toward the back of the body member; and (d.) the 35 mm slide in the standard 35 mm slide mount placed adjacent the inner side of the removable planar frame member and covering the opening.

* * * * *

UNITED STATES PATENT AND TRADEMARK OFFICE

CERTIFICATE OF CORRECTION

PATENT NO. : 5,761,838

DATED : June 9, 1998

INVENTOR(S) : Brian J. Chisholm, Lori Ann Melchiorre, and Kathleen Kendra

It is certified that error appears in the above-indentified patent and that said Letters Patent is hereby corrected as shown below:

On the title page, item [57]

Abstract, line 3, delete "transparency" insert --slide mount--.

Column 1, line 58, after "in a standard 35 mm" insert --slide mount--.

Column 4, line 49, delete "diff-user" insert --diffuser--.

Column 5, line 26, after "with" delete "with".

Column 5, line 28, after "in" delete "in".

Column 6, line 63, delete "(d.) insert --(e.)--.

Signed and Sealed this

Twenty-fifth Day of August, 1998

Bruce Lehman

*Attest:*

BRUCE LEHMAN

*Attesting Officer*

*Commissioner of Patents and Trademarks*